US006796673B1

(12) United States Patent
Dempsey et al.

(10) Patent No.: US 6,796,673 B1
(45) Date of Patent: Sep. 28, 2004

(54) ILLUMINATED RESTAURANT BILLFOLD

(75) Inventors: Joseph Dempsey, Long Beach, CA (US); Robert Lonas, El Segundo, CA (US)

(73) Assignee: Illuminated Check Presenter LLC, Long Beach, CA (US)

( * ) Notice: Subject to any disclaimer, the term of this patent is extended or adjusted under 35 U.S.C. 154(b) by 0 days.

(21) Appl. No.: 10/628,648

(22) Filed: Jul. 28, 2003

(51) Int. Cl.[7] ..... F21V 33/00
(52) U.S. Cl. ..... 362/154; 362/98; 340/286.09
(58) Field of Search ..... 340/321, 286.09; 362/154, 155, 98, 99

(56) References Cited

U.S. PATENT DOCUMENTS

| | | | | |
|---|---|---|---|---|
| 2,563,693 A | | 8/1951 | Russell | |
| 2,565,980 A | | 8/1951 | Moore | |
| 2,659,486 A | | 11/1953 | Krupin | |
| 3,558,871 A | | 1/1971 | Rogers | 240/13 |
| 3,810,164 A | | 5/1974 | Lambert | 340/332 |
| 3,821,707 A | | 6/1974 | Peters | 340/171 R |
| 3,967,274 A | | 6/1976 | Howell | 340/380 |
| 4,222,111 A | | 9/1980 | Sloan et al. | 364/900 |
| 4,250,491 A | | 2/1981 | Dotson | 340/321 |
| 4,530,067 A | | 7/1985 | Dorr | 364/900 |
| 4,701,849 A | | 10/1987 | Elden | 364/401 |
| 4,777,488 A | | 10/1988 | Carlman, Jr. et al. | 340/825.72 |
| 5,016,262 A | | 5/1991 | Cushing | 377/15 |
| 5,355,115 A | * | 10/1994 | Goor et al. | 340/321 |
| 5,813,748 A | * | 9/1998 | Maxymych | 362/154 |
| 6,302,563 B1 | * | 10/2001 | Yama | 362/253 |
| 6,409,357 B1 | | 6/2002 | Thompson et al. | 362/98 |

* cited by examiner

*Primary Examiner*—Laura K. Tso
(74) *Attorney, Agent, or Firm*—Fulwider Patton Lee & Utecht, LLP

(57) ABSTRACT

A restaurant billfold is disclosed with an illuminated signaling beacon for signaling a server that the billfold and payment are ready to be collected. The signaling beacon is mounted on the front of the billfold and includes a pressure-actuating electrical or mechanical switch that turns on and off a light source such as an LED, The light source is enclosed in a housing comprising a bracket mounted on the front of the billfold and a back plate mounted on the inside of the billfold, where the bracket and back plate cooperate to sandwich a front panel of the billfold therebetween.

9 Claims, 1 Drawing Sheet

ILLUMINATED RESTAURANT BILLFOLD

BACKGROUND OF THE INVENTION

1. Field of the Invention

The present invention is directed generally to restaurant billfolds of the type used to present a customer a check and receive payment, and more particularly to a billfold with visible signaling capabilities that allow a customer to alert a server when the payment is ready to be collected.

2. Description of Related Art

It is well known in the art of establishments that serve food and beverages such as bars, restaurants, diners, and the like, to present the check at the end of the meal in a foldable billfold or check presenter that encloses the bill and includes pockets for receiving the payment. Such billfolds are favored because they are discrete, and can also serve as a notice to the customer that the server will collect the payment at the table, rather than at a register or some other location. These billfolds traditionally comprise a leather or plastic cover that encloses a stiff web, such as might be constructed of cardboard or the like. The covers form two complimentary halves that are connected at a spine and fold together in a book-like arrangement. A pocket that is shaped and sized to receive a portion of a standard size credit card is often provided that permits the credit card to partially protrude outside of the billfold. Sleeves or pockets may also be included to enclose the check and retain currency should that form of payment be selected. However, when cash or other currency is used to pay the bill, there is typically nothing in the appearance of the billfold that indicates to the server that it is ready to be collected.

An issue that comes up repeatedly with the use of such restaurant billfolds is the timing of its retrieval by the server. Typically after dropping off the bill, the server will tend to other matters to allow the patron to finish the meal, continue conversations, and so forth. After some time has passed, the server may approach the customer to collect the payment of the check before the customer has had an opportunity to review the bill and select the proper payment. The premature attempt to collect the bill payment can be embarrassing to the customer as well as the server, and cause the customer to interrupt his meal or conversation to attend to the payment of the bill. Alternatively, the server having already attempted to collect the bill once and been premature may error on the side of caution and prolong the period of the next attempt, leading to the customer unnecessarily waiting an extended period for the server to collect his payment.

The customer may also wait unnecessarily long for the server if the customer is ready to pay but the server is unaware or preoccupied. The server may wait for a designated period of time after leaving the check to allow the customer ample time to review the bill and finish the meal. In many cases the server may wait until the customer signals that he is ready to have the billfold collected, but the customer may be unaware that the server is waiting for him. The customer may be in a hurry to leave the restaurant and wish to promptly pay the bill at the earliest opportunity. In short, there is often times a lack of communication between the customer and the server in regards to the collection of the check at the end of the meal, and such lack of communication can result in an unfavorable impression of the establishment and a bad experience for the consumed meal. In this vein, the prior art lacks a discrete and convenient means of signaling to the server both the readiness of the customer to have the bill payment collected as well as the potential urgency of the customer's preference to have the transaction completed with alacrity.

SUMMARY OF THE INVENTION

The present invention is a restaurant billfold with an illuminated signaling system on the billfold's exterior that permits a restaurant patron to notify his server when the billfold is ready to be collected, and can preferably further communicate to the server an urgency through a differentiation of the illumination (such as a hastening of the illumination blinking or a change in the illumination intensity) between a normal pick-up mode and an urgent pick-up mode. The present invention preferably comprises a standard restaurant billfold modified with a manually actuated pressure sensitive illuminating beacon disposed on an exterior surface thereof that sends a signal visible to a nearby server or staff employee that the billfold is ready to be picked up and payment is enclosed inside.

In a more preferred embodiment the illuminating beacon comprises a bracket and base plate combination that cooperate to house an illumination source and power supply therebetween. In this embodiment, the bracket housing the illumination source is disposed on the outer surface of the billfold and includes spacing posts that pass through the billfold panel to secure the bracket to the billfold. The base plate is disposed at a complimentary position on the inner surface of the billfold adjacent the spacing posts. Fasteners or rivets preferably connect the back plate to the front bracket at corresponding holes in the spacing posts to secure the bracket and back plate together into a fixed unit.

The bracket on the outside surface of the billfold includes a window or void to expose an illumination source that serves as the signaling means for the present invention. The illumination source radiates light through the void or window so as to be readily viewed from twenty to thirty feet away. The window can be a lens that helps to disperse or focus the light emanating from the illumination source, or the window can be a void in the bracket that simply permits light to escape and radiate normally. In a preferred embodiment the illumination source can be programmed to blink or otherwise include two intensities or colors to reflect multiple states of urgency of the restaurant patron. The illumination source preferably cooperates with a circuit board that controls the switching and illumination modes of the light, where the illumination source physically resides on top of the circuit board and electrical power is supplied through the circuit board to the illumination source.

The circuit board is preferably shaped to correspond to the shape of the illumination source, such that the illumination source and the circuit board have mating surfaces that facilitate their electrical contact and physical cooperation. The circuit board is preferably seated on a disk-shaped battery that powers both the circuit board and the illumination source. A mechanical or electrical switch on the circuit board makes and breaks contact between the power supply and the illumination source to actuate and extinguish the light therefrom based upon manual pressure applied to the illumination source. That is, the illumination source is controlled by the circuit board and actuated by pressing on the illumination source lens. In this manner, a patron can depress the illumination source and actuate the signaling function of the present invention. Additional pressing can, in a preferred embodiment, cycle through various alternate signaling functions such as blinking, a change in intensity or color, or some other variation in the standard signaling mode.

DETAILED DESCRIPTION OF THE PREFERRED EMBODIMENTS

Figures 1, 2, 3, 4:
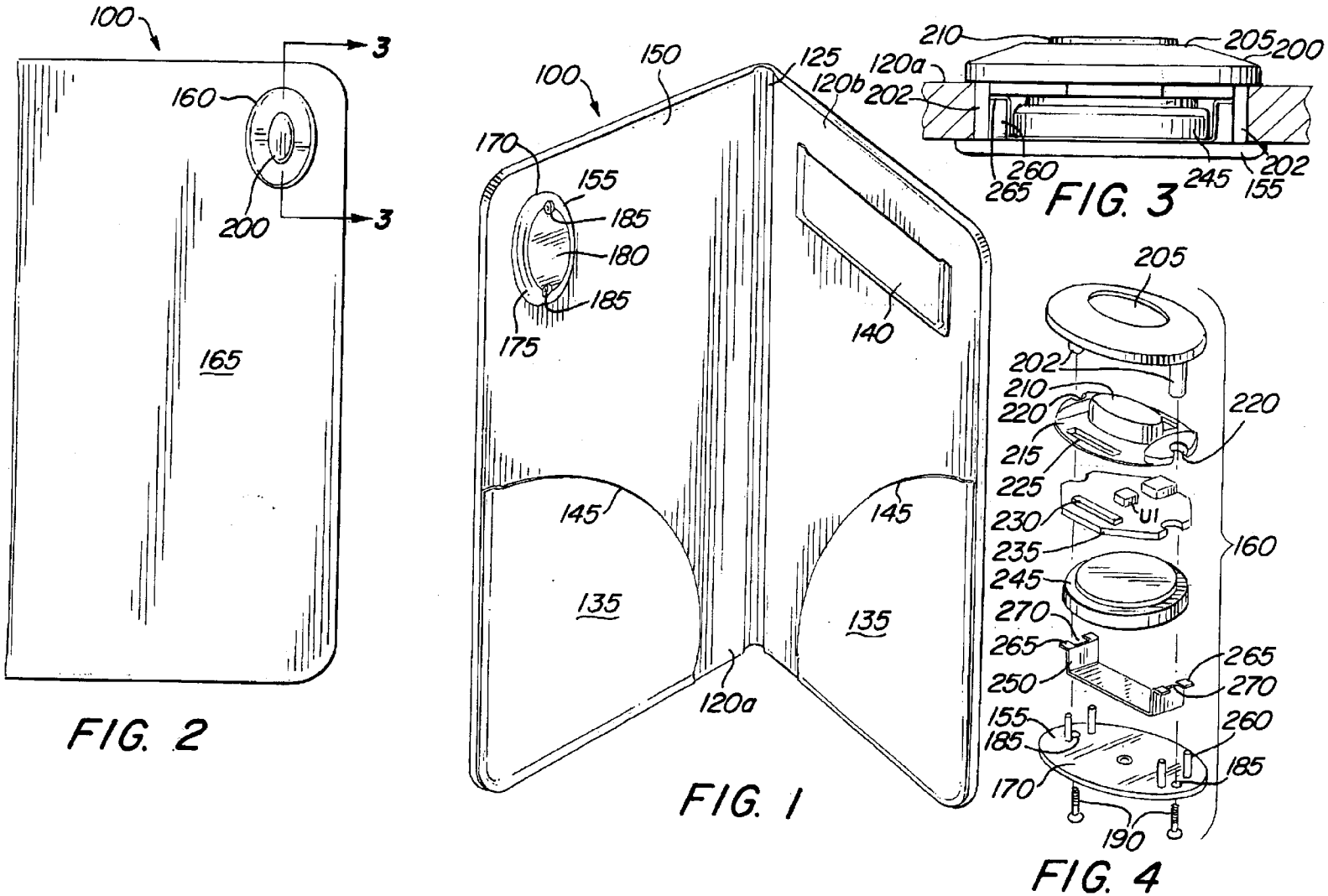
FIG. 1 is an elevated perspective view of a first preferred embodiment of the present invention.
FIG. 2 is a front view of the first preferred embodiment of FIG. 1.
FIG. 3 is an enlarged, cross-sectional view of the signaling beacon taken along lines 3—3 in FIG. 2.
FIG. 4 is an exploded view of the signaling beacon of FIG. 3.

The present invention is characterized by a restaurant billfold 100 that opens and folds closed to receive and enclose a check and payment therein. As shown in FIG. 1, the billfold 100 generally comprises first and second panels or covers 120*a*, 120*b* joined along a first edge by a flexible spine 125 that couples the covers and permits the billfold 100 to open and close like a book. The billfold's interior may include pockets or sleeves 135, 140 for retaining currency as well as a credit card and a customer's check. The sleeves 135 are typically rounded at an upper surface 145 to allow a portion of the enclosed items to extend beyond the sleeve 135 for easy grasping. The billfold's construction is sufficiently well known in the art that further description is not necessary for an understanding of the invention.

The billfold 100 of the present invention has at an interior surface 150 of the front cover 120*a* a back plate 155 that forms a portion of the housing for the illuminating signaling beacon 160 on the exterior surface 165 of the billfold 100. The back plate 155 may comprise a substantially oval base 170, an inclined side wall 175 along its perimeter, leading to an oval-shaped top surface 180. At opposite ends of the back plate 155 are cylindrical recesses 185 for receiving a threaded fastener 190, said fasteners 190 cooperating to secure the back plate 155 to the oval bracket 200 on the exterior surface 165 of the front cover 120*a*. Thus, as explained in more detail below, the back plate 155 and the oval bracket 200 lie on opposite sides of the front cover 120*a* and cooperate to sandwich the front cover therebetween in a fixed relationship using the threaded fasteners 190 to engage the two components.

FIG. 2 illustrates the front of the billfold 100, and in particular shows an ovular bracket 200 at a complimentary position to the back plate 155 on the interior surface 150 of the front cover 120*a*. The ovular bracket 200 includes a window 205 that may be a void, a translucent covering, or a transparent covering, and inside the window is an illumination source 210 such as an light emitting diode (LED) or an incandescent bulb. The illumination source 210 is preferably mounted on an ovular face plate 215, where the illumination source 210 projects upwardly so as to protrude into the window 205 on the overlaid bracket 200. The face plate 215 preferably includes circular recesses 220 on each respective end to be received by alignment posts 202 on the ovular bracket 200. The cooperation of the posts 202 in the circular recesses 220 of the face plate 215 assure proper alignment of the illumination source 210 and surrounding bracket 200 and prevents the illumination source 210 from shifting or sliding out of position. The face plate 215 further includes a longitudinal slot 225 adjacent the illumination source 210 that mates with a projecting tab 230 on a circuit board 235 to couple the illumination source 210 and circuit board 235 in vertical and horizontal alignment. That is, when placed on the circuit board 235, the face plate 215 supporting the illumination source 210 has a slot 225 that cooperates with a tab 230 on the circuit board 235 to interlock and position the face plate 215 thereon. The interlocking complimentary tab 230 and slot 225 also ensure electrical contact between the illumination source 210 and the circuit board 235.

The circuit board 235 can be of the type no 90-100002-901 sold by Electro-Tech Products, Inc. of Glendora, Calif. FIG. 4 shows a microchip U1 mounted on the circuit board 235 for carrying out the timing function and blinking function of the illumination source 210. The timing function may include an automatic shut-off after a predetermined period to prevent the power supply from discharging in the event the signaling beacon is inadvertently left on for an extended period.

Below the circuit aboard 235 is a power supply 245 such as a three volt battery cell, where said circuit board 235 is in electrical communication with the battery cell 245 and said cell provides electrical power to operate the circuit board 235. Below the battery cell 245 is the back plate 155, such that a columnar arrangement is created to form the signaling beacon 160 comprising the bracket 200 with the window 205, the illumination source 210, the circuit board 235, the power supply 245, and the back plate 155. In a preferred embodiment there is a non-conducting power supply holder 250 disposed between the power supply 245 and the back plate 155 to prevent current leakage through the back plate.

As shown in FIG. 4, the back plate 155 may further comprise a series of pegs 260 projecting upwardly from the inner surface and serve to support the circuit board 235 and illumination source 210. The pegs 260 are positioned to receive outwardly projecting flaps 265 on the power supply holder 250 as shown in FIGS. 3 and 4. The cooperation of the pegs 260, flaps 256, and circuit board 235 help to form a solid structure for the components. A gap 270 between the outwardly projecting flaps 265 allow the spacing posts 202 to extend past the power supply holder and contact the inner surface of the back plate 155, where the fasteners 190 extend through recesses 185 and threaded cavities (not shown) in the spacing posts 202 to rigidly secure the housing for the illuminating signaling beacon together.

In use, a restaurant server ordinarily after the meal has been completed would present the billfold 100 to the patron closed like a book with a bill for the meal therein. At the patron's leisure, he would place a form of payment (not shown) into one of the pockets 135, 140 and close the billfold again. The patron would then depress the illumination source 210 through the window 205 of the signaling beacon on the outer surface 165 of the front cover 120*a*. Depressing the illumination source 210 actuates a switch on the circuit board 235 to close an electrical circuit directing power from the power supply 245 to the illumination source 210. The introduction of electrical current to the illumination source 210 causes the illumination source to radiate light outwardly through the window 205 such that the radiating light can be viewed for a distance away from the billfold 100. The intensity of the illumination source may be chosen depending on the lighting environment of the particular establishment, where a diner may have different lighting conditions that a elegant restaurant. Placed on the table, the radiating signal from the illumination source can be viewed by the server, whereupon the server is notified that the bill has been paid and payment is enclosed. The server collects the payment and completes any further transactions necessary to free the patron to leave. If the server does not notice the illuminating signaling beacon initially and the patron is in a hurry, the patron may depress the illumination source a second time to change the radiating light to a blinking pattern, a higher intensity, a different color, or some other deviation to indicate to the server that a certain urgency is required to collect the payment. In this manner, the customer does not have to wait unnecessarily while the paid bill rests unnoticed on his table.

Those of skill in the art will recognize that many variations of the present invention can be practiced without departing from the spirit and scope of the present invention. The foregoing description provides the inventor's best mode for carrying out his invention, but is illustrative rather than limiting in its scope. The scope of the invention should not be construed as limited by any specific, embodiment detailed in the description of the invention, but rather the scope of the invention should be delimited only by the appended claims below.

What is claimed is:

1. A restaurant billfold comprising: front and back panels connected together along respective first edges by a flexible spine, said panels each including an outer surface and an inner surface;

a illuminating signaling beacon disposed on the outer surface of the front panel, said illuminating signaling beacon comprising:

a bracket mounted to the outer surface of the front panel, said bracket having a body portion with a window centrally disposed therein, and further comprising posts depending from the body portion and extending through said front panel;

an illumination source adjacent the bracket and visible through said window;

a circuit board in cooperative relationship with the illumination source, said circuit board controlling an actuation of the illumination source;

a power supply in electrical communication with the circuit board for powering the circuit board and the illumination source; and a back plate mounted on the inner surface of the front panel, said back plate cooperating with the posts on the bracket to sandwich the front panel between the bracket and the back panel in a fixed relationship.

2. The restaurant billfold of claim 1 further comprising:

a pressure sensitive switch for actuating said illumination source, said switch engaging and disengaging said power supply with said illumination source based upon manual pressure applied to the illumination source.

3. The restaurant billfold of claim 2 further comprising:

an insulating clip disposed between the power source and the back plate.

4. The restaurant billfold of claim 2 wherein the posts of said bracket include threaded channels for receiving a fastener therein, and the signaling beacon further comprises a threaded fastener for each post coupling the back plate to the bracket.

5. The restaurant billfold of claim 2 wherein the circuit board and illumination source include notches for receiving the posts of the bracket therein.

6. The restaurant billfold of claim 2 wherein the illumination source is an LED mounted on a face plate, said LED projecting into the window of the bracket.

7. The restaurant billfold of claim 6 wherein the face plate includes a slot sized to receive a tab on the circuit board to interlock the circuit board to the LED.

8. A restaurant billfold comprising:

front and back panels connected together along respective first edges by a flexible spine, said panels each including an outer surface and an inner surface;

a illuminating signaling beacon disposed on the outer surface of the front panel, said illuminating signaling beacon comprising:

an ovular bracket mounted to the outer surface of the front panel, said bracket having a body portion with an oval window centrally disposed therein, and further comprising a pair of posts depending from opposite ends of the body portion for passing through said front panel so as to extend through to the inner surface of the front panel;

an ovular light emitting diode (LED) adjacent the bracket and visible through said oval window;

a circuit board including a microchip, adjacent the LED, said circuit board controlling an actuation of the LED;

a three volt power supply in electrical communication with the circuit board for powering the LED; and a back plate mounted on the inner surface of the front panel, said back plate cooperating with the posts on the bracket to sandwich the front panel between the bracket and the back panel in a fixed relationship.

9. The restaurant billfold of claim 8 wherein the illuminating signaling beacon further comprises a pressure sensitive switch to actuate the LED.

* * * * *